US005222667A

United States Patent [19]

Fujikawa et al.

[11] Patent Number: 5,222,667

[45] Date of Patent: Jun. 29, 1993

[54] CONTAINER MADE OF PAPER-BASE LAMINATE

[75] Inventors: Yasuji Fujikawa; Kazuo Abe; Shoji Hirose; Shoji Nishioka, all of Tokushima, Japan

[73] Assignee: Shikoku Kakoki Co., Ltd., Tokushima, Japan

[21] Appl. No.: 922,728

[22] Filed: Jul. 31, 1992

[30] Foreign Application Priority Data

Feb. 5, 1991 [JP] Japan ..... 3-14049

[51] Int. Cl.[5] ..... B65D 5/02

[52] U.S. Cl. ..... 229/137; 229/104; 229/184

[58] Field of Search ..... 229/104, 137, 138, 184, 229/198.2, 125.42, 915.1

[56] References Cited

U.S. PATENT DOCUMENTS

| | | | |
|---|---|---|---|
| 512,571 | 1/1894 | Walker | 229/104 |
| 1,941,843 | 1/1934 | Kulpinski | 229/104 |
| 2,070,747 | 2/1937 | Orstrom | 229/104 |
| 2,232,008 | 2/1941 | Waters | 229/104 |
| 3,586,232 | 6/1971 | Scully | 229/104 |
| 3,712,844 | 1/1973 | Ratten et al. | 229/198.2 |
| 3,908,888 | 9/1975 | Gordon | 229/198.2 |
| 3,971,300 | 7/1976 | Bachner | 229/138 |
| 4,761,156 | 2/1988 | Bachner et al. . | |
| 4,838,847 | 6/1989 | Kume et al. . | |
| 4,991,768 | 2/1991 | Kondo | 229/137 |
| 5,029,751 | 7/1991 | Detzel | 229/137 |
| 5,056,707 | 10/1991 | Larsen | 229/104 |
| 5,152,736 | 6/1992 | Owen et al. . | |

FOREIGN PATENT DOCUMENTS

| | | |
|---|---|---|
| EPA-A 0281206 | 7/1988 | European Pat Off. . |
| EPA-A 0380252 | 1/1990 | European Pat Off. . |
| GB-A 511330 | 8/1939 | United Kingdom . |
| GB-A 987633 | 3/1965 | United Kingdom . |

*Primary Examiner*—Gary E. Elkins
*Attorney, Agent, or Firm*—Armstrong, Westerman, Hattori, McLeland & Naughton

[57] ABSTRACT

A paper-base laminate container having a bottom closure formed with a recess. The recess has an inverted V-shaped cross section and extends across the bottom closure through the center thereof for positioning the container upright with good stability.

2 Claims, 6 Drawing Sheets

CONTAINER MADE OF PAPER-BASE LAMINATE

BACKGROUND OF THE INVENTION

The present invention relates to a container made of paper-base laminate and filled with contents such as fluid food.

Such containers have a closed bottom portion generally bulging outward, are therefore not positionable upright with good stability but tend to rock, and can not be displayed in a stable position. Further when allowed to rock, the container becomes damaged at the corners of the closed bottom portion.

To overcome the above problem, the present applicant has already proposed a container having a bottom portion which is recessed in the form of a pyramid centrally thereof (see U.S. Pat. No. 4,838,847).

The container proposed by the present applicant is positionable with good stability, whereas the liquid level within the container rises by an amount corresponding to the bottom recess of the container. The liquid is then likely to spill from the container during transport. This must be prevented by reducing the transport speed of the container transport conveyor, consequently entailing the problem of impairing the efficiency of the packaging machine.

SUMMARY OF THE INVENTION

The main object of the present invention is to overcome the foregoing problems and provide a paper-base laminate container.

The container of the present invention is made of paper-base laminate and has a bottom closure formed with a recess having an inverted V-shaped cross section and extending across the bottom closure through the center thereof for positioning the container upright with stability.

The paper-base laminate container of the invention is formed in its bottom closure with a recess of inverted V-shaped cross section extending across the bottom closure through the center thereof, so that the recess diminishes the bulge of the bottom closure and does not raise the liquid level in the container as greatly as the conventional pyramidal recess, consequently obviating the likelihood of the liquid spilling from the container, permitting the packaging machine to exhibit its ability without impairment and giving improved stability to the container.

DESCRIPTION OF THE PREFERRED EMBODIMENTS

Embodiments of the invention will be described below with reference to the drawings.

Figure 4:
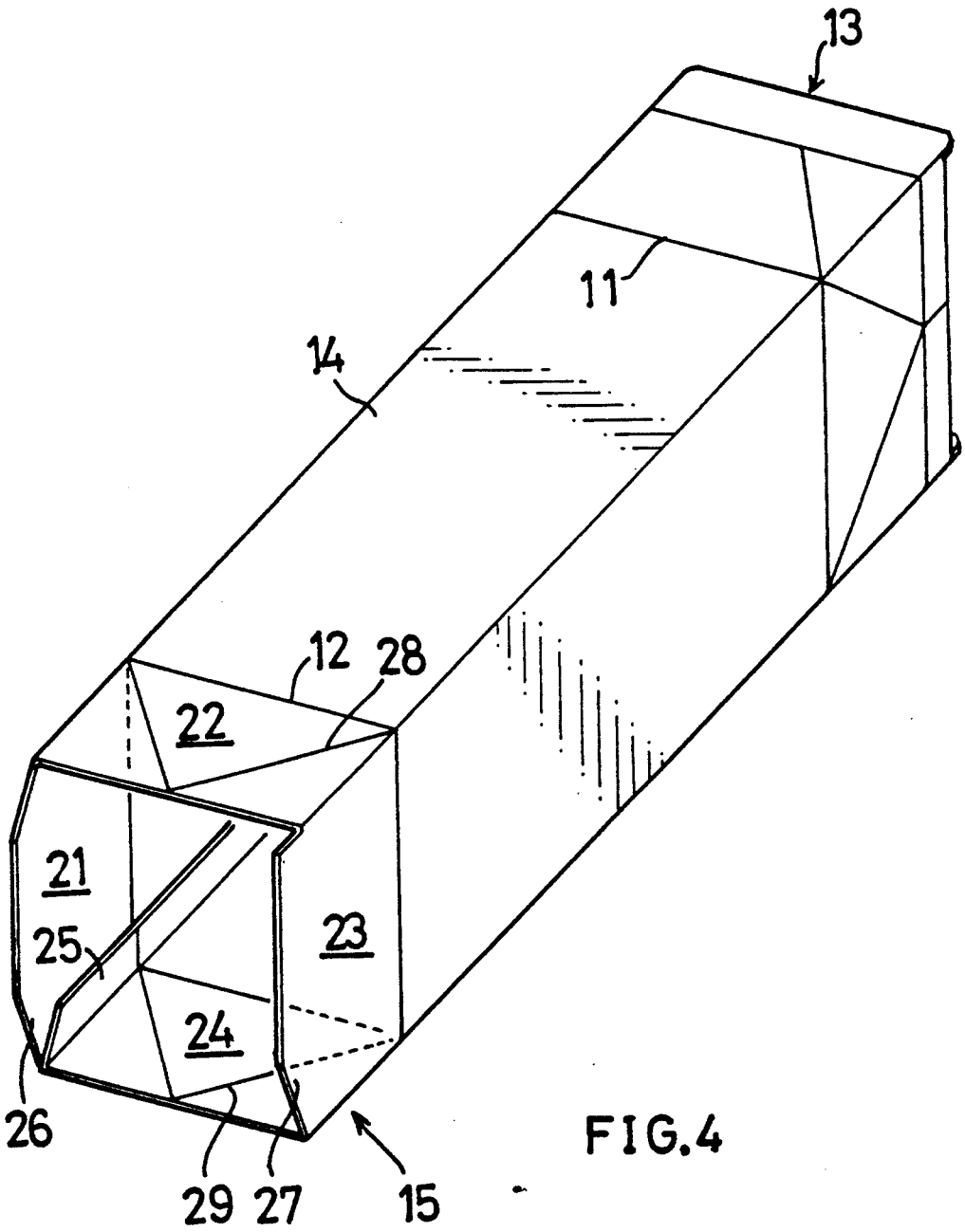
FIG. 4 is a perspective view of the container bottom portion before it is formed.

With reference to FIG. 4 showing a container before its bottom portion is closed, the container comprises a top closure 13, trunk 14 and bottom closure 15 which are divided by upper and lower scores 11, 12 but which are integral with one another as arranged downward. Of these portions 13 to 15, the top closure 13 and the trunk 14 are irrelevant to the present invention and will not be described therefore.

The bottom closure 15 has four generally rectangular panels, i.e., first to fourth bottom panels 21 to 24. The fourth bottom panel 24 has an edge integral with a striplike fifth bottom panel 25, which is joined to the inner surface of the first bottom panel 21, whereby the four bottom panels 21 to 24 are made to extend endlessly. Striplike seal panels 26, 27 are integral with the forward ends of the first bottom panel 21 and the third bottom panel 23, respectively. The second bottom panel 22 and the fourth bottom panel 24 are formed with V-shaped scores 28, 29, respectively.

Figure 2:
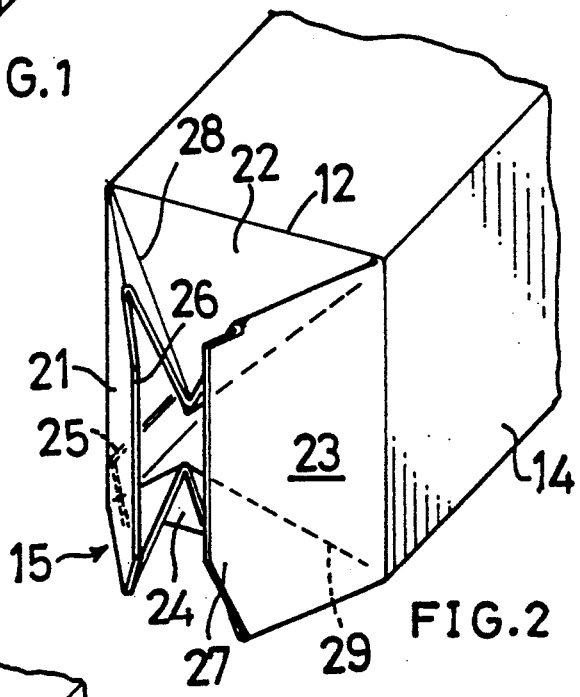
FIG. 2 is a perspective view showing a step of forming the container bottom portion.
Figure 3:
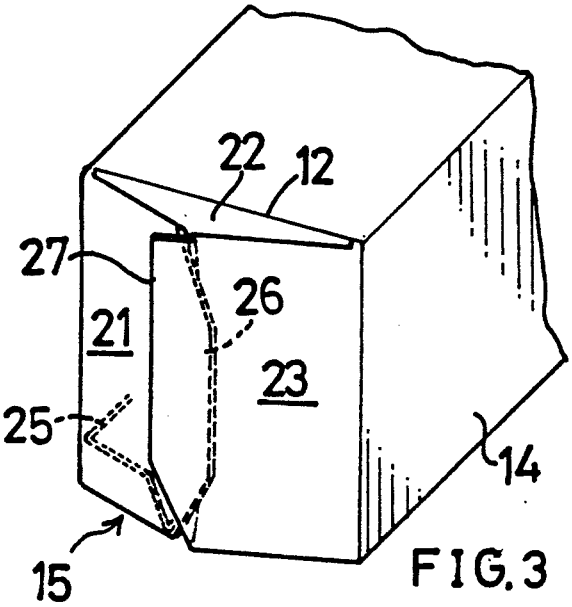
FIG. 3 is a perspective view showing a step of forming the container bottom portion subsequent to the step of FIG. 2.

The bottom portion of the container is formed in the manner to be described below with reference to FIGS. 2 and 3. First, the second bottom panel 22 and the fourth bottom panel 24 are each folded on itself along the V-shaped score 28 or 29 while being folded inward, and the first bottom panel 21 and the third bottom panel 23 are then folded over the folded second and fourth bottom panels 22 and 24. The seal panel 26 integral with the first bottom panel 21 is further inserted into a clearance between the third bottom panel 23 and triangular portions of the second and fourth bottom panels 22, 24 thereunder, and the seal panel 27 integral with the third bottom panel 23 is lapped over the first bottom panel 21. Each of the panels is then bonded to another one of the panels with pressure at portions thereof where the panels are in contact with each other.

Figure 5:
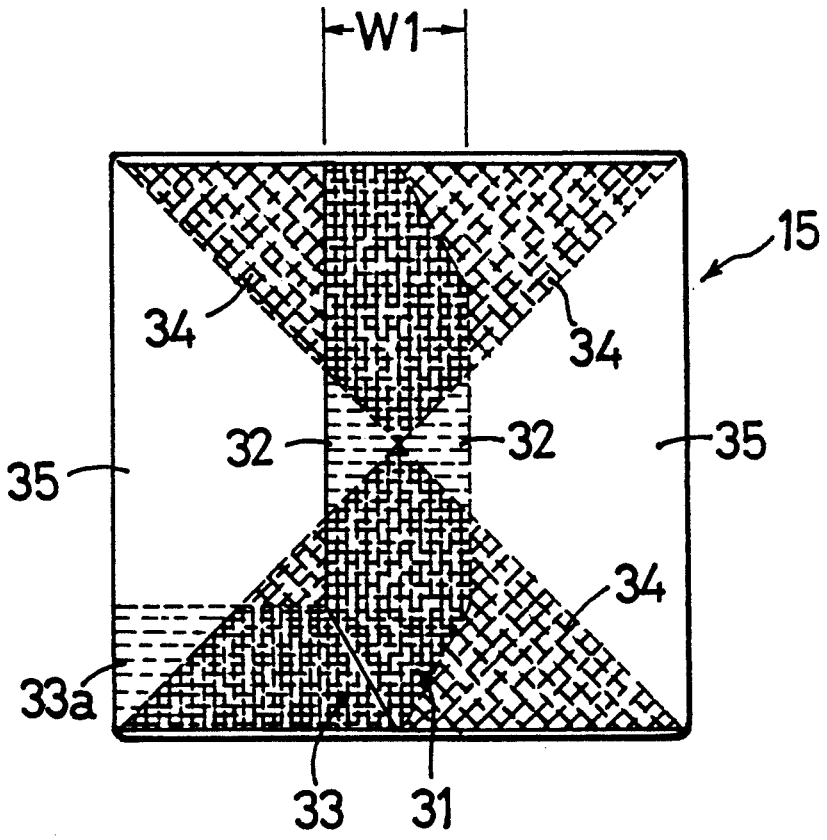
FIG. 5 is a diagram illustrating laps of a container blank for forming the container bottom portion.

According to the lapping mode of the container blank, the bottom closure 15 thus formed is divided into the five regions to be described below with reference to FIG. 5. A first region 31 is a striplike portion extending across the bottom of the container through the center thereof and including two triangular second regions 32 at the midportion of its length, with their apexes butting against each other. Except for the second regions 32, the first region 31 has four times the thickness of the container blank. The second regions 32 have twice the blank thickness. The bottom closure 15 has another region having four times the thickness of the blank, i.e., a third region 33 including the lap of fifth bottom panel 25. The third region 33 partly includes a region **33*a* having twice the blank thickness. Generally triangular fourth regions 34 having three times the thickness of the blank are present on opposite sides of the first region 31. The remaining portions are fifth regions 35** having the thickness of the blank.

Figure 1:
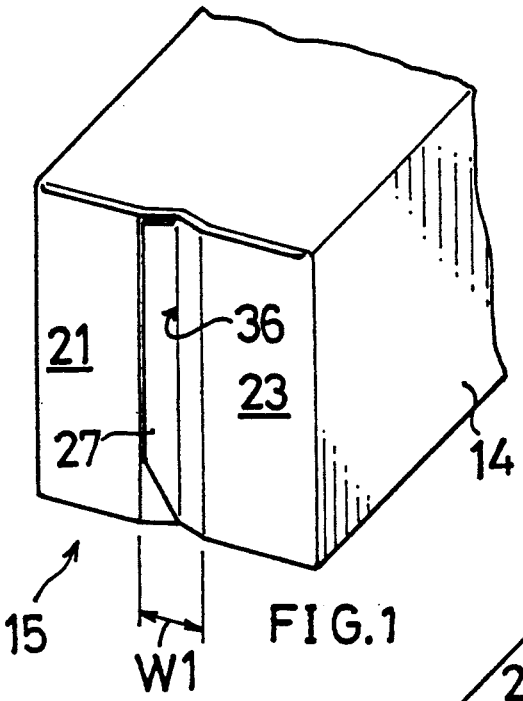
FIG. 1 is a perspective view of a container bottom portion.
Figure 6:
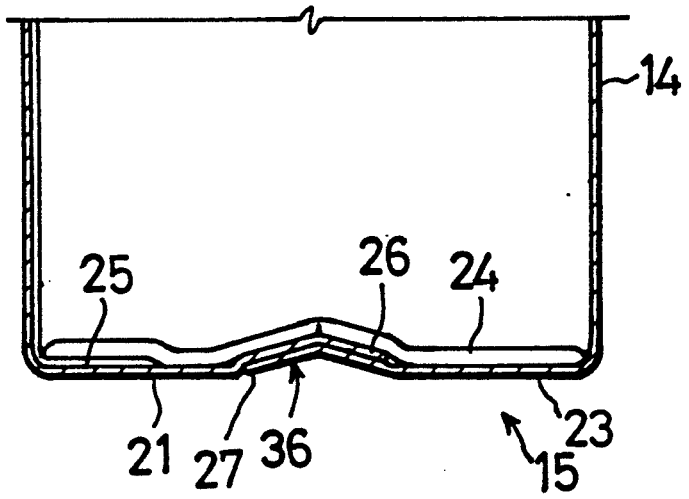
FIG. 6 is a sectional view of the container bottom portion.

As shown in FIGS. 1 and 6, the first region 1 is formed with a recess 36 having an inverted V-shaped cross section.

The striplike region including the two seal panels 26, 27 has four times the thickness of the blank given by laps and is relatively great in strength. The presence of the recess 36 in this region of great strength reinforces the bottom closure 15, giving an increased strength to the bottom closure 15 of the container.

Figure 7:
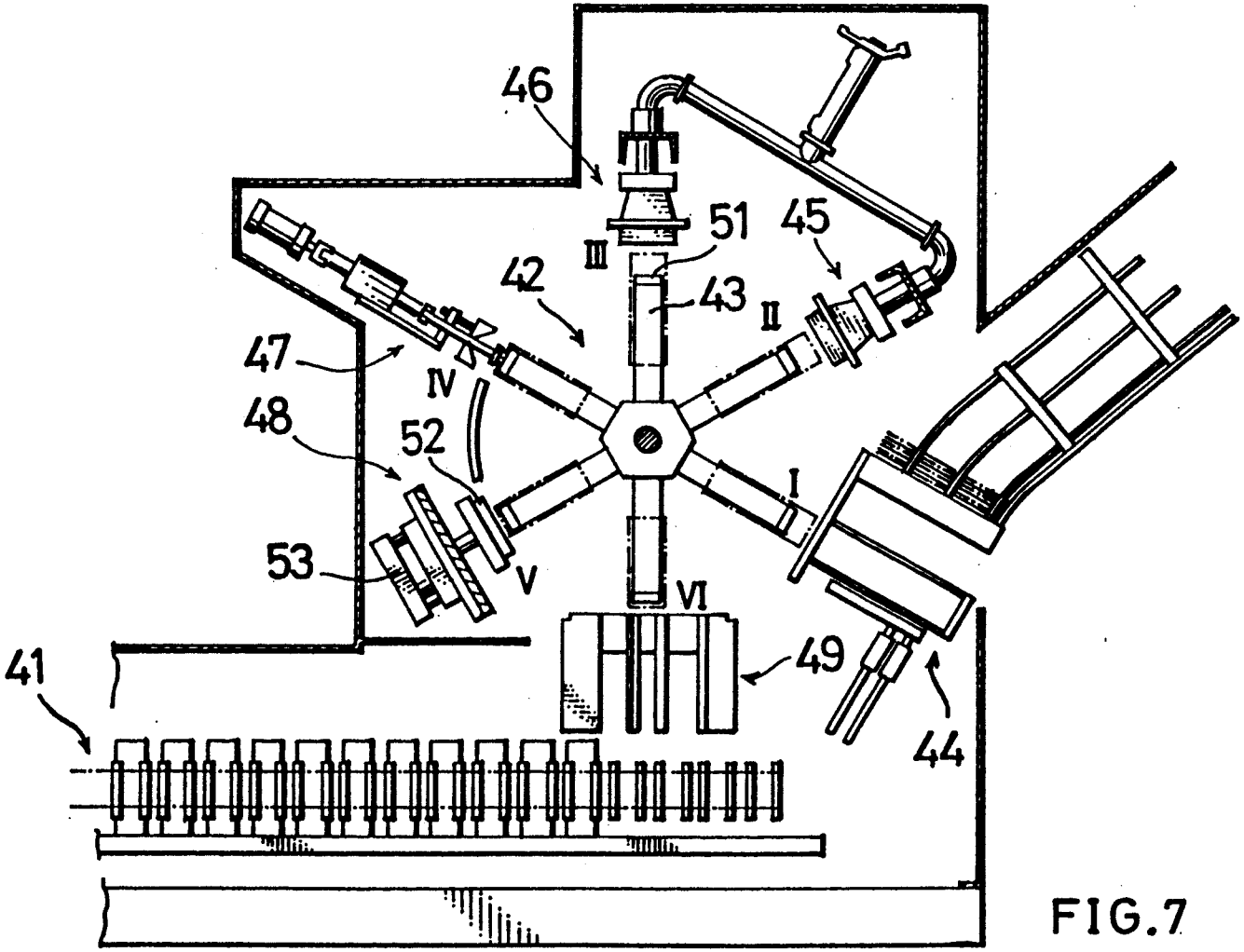
FIG. 7 is a side elevation schematically showing a packaging machine including a bottom bonding unit.

A packaging machine will be described next which includes a unit for bonding the bottom portion of the container with pressure. As seen in FIG. 7, the machine comprises a rotor 42 disposed above the starting end of a transport path provided by a container transport conveyor 41. The rotor 42 has six radial mandrels 43 and is intermittently driven so that the mandrels 43 successively stop at each of six stations, i.e., first to sixth processing stations I to VI. The first to sixth processing stations I to VI are provided with a container feeder 44, primary container bottom heater 45, secondary container bottom heater 46, container bottom folding unit 47, container bottom bonding unit 48 and container transfer unit 49, respectively.

Of these devices and units, those other than the mandrels 43 and the bottom bonding unit 48 are known and therefore will not be described in detail.

Each of the mandrels 43 has a mandrel cap 51 attached to its forward end. The bottom bonding unit 48 has a bonding member 52, which is attached to the piston rod of a hydraulic cylinder 53 and is movable axially of the mandrel 43 as stopped at the fifth processing station V.

Figure 8:
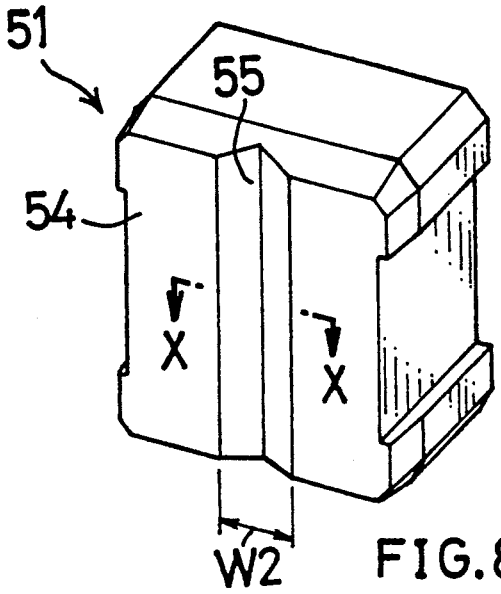
FIG. 8 is a perspective view showing the forward end face of a mandrel.
Figure 10:
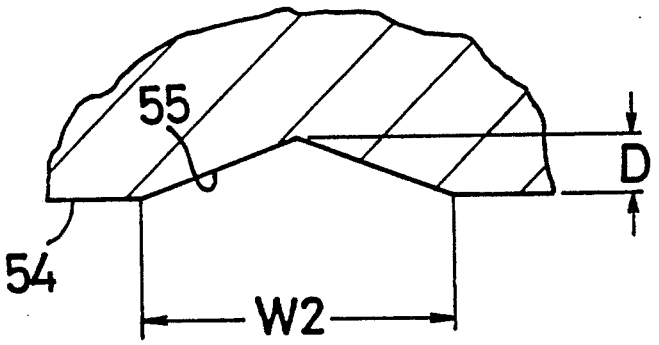
FIG. 10 is a view in section taken along the line X—X in FIG. 8.

As shown in greater detail in FIGS. 8 and 10, the mandrel cap 51 has an outer face 54 which is formed with a groove 55 having a V-shaped cross section for forming the recess 36 in the bottom closure 15. The grooved portion 55 serves to press the first region 31. The groove 55 extends across the outer face 54 through the center thereof and has a width W2 approximately equal to the width W1 of the first region 31 (see FIG. 5). For example when the bottom closure 15 is 70 mm× 70 mm in size, the groove 55 has a depth D of about 2.5 mm.

Figure 9:
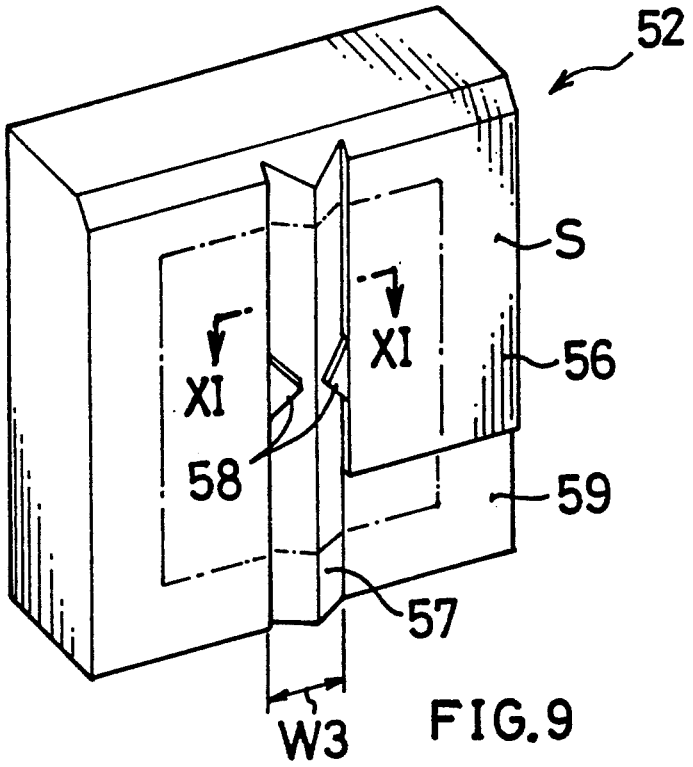
FIG. 9 is a perspective view showing a pressing face of a bonding member.
Figure 11:
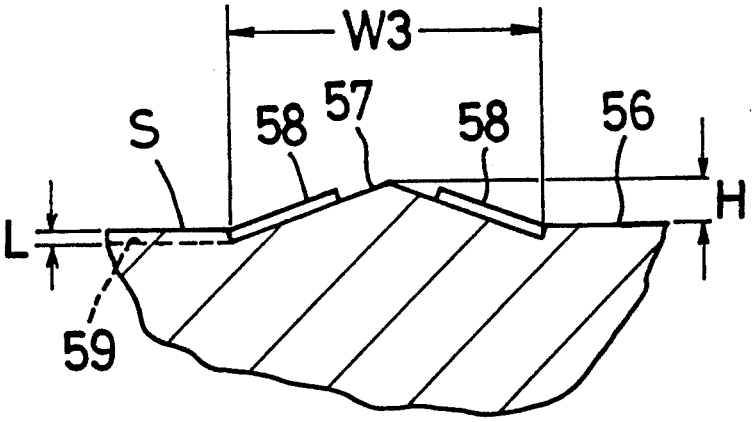
FIG. 11 is a view in section taken along the line XI—XI in FIG. 9.

Referring to FIGS. 9 and 11, the bonding member 52 has a pressing face 56 which is formed with a projection 57 V-shaped in cross section and corresponding to the groove 55. The base end of the projection 57 is at a level a small distance L, e.g., 0.3 mm, below a reference plane S of the pressing face 56. The height H of the projection 57 from the reference plane S is approximately equal to the depth D of the groove 55. The projection 57 is provided at the midportion of its length with two triangular protrusions 58 for pressing the second regions 32. The base end of each protrusion 58 is positioned at the same level as the reference plane S. At one side of the projection 57, one corner of the pressing face 56 has a recessed portion 59 for pressing the third region 33. The recessed portion 59 is at a level lower than the reference plane S by the above-mentioned distance L.

When the bonding member 52 is pressed from outside against the bottom closure 15 which is folded flat and supported by the forward end of the mandrel 43 from the inside, the panels forming the closure 15 are bonded together with the pressure. At this time, the bottom closure 15 is shaped in conformity with the groove 55 of the mandrel 43 and the projection 57 of the bonding member 52, that is, the first region 31 is pressed into an inverted V-shape in cross section, whereby the recess 36 is formed.

What is claimed is:

1. A container made of paper-base laminate and having a bottom closure having a center, the bottom closure having a portion formed with a recess which has an inverted V-shaped cross section and which extends across the bottom closure through the center of the bottom closure, the recess for positioning the container upright with stability, the portion of the bottom closure having the formed recess comprising two or more panels each having an equal thickness which are folded to overlap each other and bonded to each other such that the portion of the bottom closure has a thickness which is at least twice the thickness of the panels.

2. A container made of paper-base laminate and having a bottom closure having a center, the bottom closure being formed with a recess having an inverted V-shaped cross section and extending across the bottom closure through the center of the bottom closure for positioning the container upright with stability, the bottom closure including a pair of outer bottom panels providing a bottom surface for the bottom closure, a pair of inner bottom panels, each inner bottom panel folded on itself inside the outer bottom panels, and a pair of striplike seal panels, one striplike seal panel integral with a forward end of each of the outer bottom panels respectively, each of the striplike seal panels lapping over a forward end portion of one of the outer bottom panels integral with the other seal panel, each of the panels being bonded to another one of the panels with pressure at portions of the panels where the panels are in contact with each other to form a bonded region having four times the thickness of one the panels, the recess being positioned at a striplike portion including the bonded region.

* * * * *